US005742231A

United States Patent [19]

Kolodin

[11] Patent Number: 5,742,231

[45] Date of Patent: Apr. 21, 1998

[54] INTRUSION DETECTION SYSTEM

[76] Inventor: Louis Kolodin, 208 Rabbit Run Rd., Cherry Hill, N.J. 08003

[21] Appl. No.: 680,670

[22] Filed: Jul. 16, 1996

[51] Int. Cl.[6] ..... G08B 13/00

[52] U.S. Cl. ..... 340/541; 340/527; 340/309.15; 340/692; 340/430

[58] Field of Search ..... 340/430, 527, 340/528, 529, 541, 309.15, 692

[56] References Cited

U.S. PATENT DOCUMENTS

| | | | |
|---|---|---|---|
| 3,613,064 | 10/1971 | Peterson et al. . | |
| 3,614,734 | 10/1971 | Davis . | |
| 3,634,844 | 1/1972 | King . | |
| 4,030,087 | 6/1977 | Ritchie et al. . | |
| 4,095,211 | 6/1978 | Shaughnessy | 340/539 |
| 4,157,540 | 6/1979 | Oros . | |
| 4,201,982 | 5/1980 | Humphries | 340/552 |
| 4,207,559 | 6/1980 | Meyer | 340/541 |
| 4,282,518 | 8/1981 | Bonner . | |
| 4,528,553 | 7/1985 | Hastings et al. | 340/526 |
| 4,755,792 | 7/1988 | Pezzolo et al. . | |
| 4,967,183 | 10/1990 | D'Ambrosia et al. | 340/552 |
| 5,117,217 | 5/1992 | Nykerk . | |
| 5,128,650 | 7/1992 | Peters et al. . | |
| 5,157,375 | 10/1992 | Drori | 340/429 |
| 5,172,093 | 12/1992 | Nose et al. . | |
| 5,172,094 | 12/1992 | Stadler . | |
| 5,216,407 | 6/1993 | Hwang . | |
| 5,264,822 | 11/1993 | Vogelman et al. | 340/692 |
| 5,347,273 | 9/1994 | Katiraie | 340/692 |
| 5,412,370 | 5/1995 | Berman et al. . | |

*Primary Examiner*—Jeffery Hofsass
*Assistant Examiner*—Daniel J. Wu
*Attorney, Agent, or Firm*—Plevy & Associates

[57] ABSTRACT

An intrusion detection system is disclosed including a warning device and a sensor for generating a sensor signal in response to an intruder. A driver coupled between the sensor and the warning device, which is operative to switch from an "off" state to an "on" state in response to the sensor signal. The driver in the "off" state disables the warning device, while in the "on" state the driver activates the warning device. The system further includes a controller for the driver, which includes an oscillator normally in a "static" or unenergized state of operation. The oscillator is activated in response to the sensor signal being continuous for a first predetermined period of time to cause the controller to lock the driver in the "on" state for a second predetermined period of time.

20 Claims, 3 Drawing Sheets

INTRUSION DETECTION SYSTEM

BACKGROUND OF THE INVENTION

1. Field of the Invention

The present invention relates generally to intrusion detection systems and more particularly, to such a system for boats which is low cost, has a low power drain and timing control that prevents the system from being activated by momentary transients.

2. Description of the Prior Art

Within recent years many boat owners have been able to purchase sophisticated equipment such as radar sets, navigation aids, depth finders and other electronic hardware. The cost of such equipment has decreased significantly which enables even owners of small boats to purchase this equipment. Even though the cost of this equipment has decreased, it is still expensive enough so that is desirable to prevent its loss from theft. Further, due to more boat owners having this sophisticated equipment, the need for anti-theft devices on boats has increased.

The prior art discloses a number of different anti-theft devices. An example of such a device is disclosed by U.S. Pat. No. 3,614,734 to Davis, entitled AUTO ALARM SYSTEM, issued Oct. 19, 1971. Davis discloses an alarm system for automobiles, which includes a multi-vibrator, external trigger and drive circuit. Another example is disclosed by U.S. Pat. No. 5,216,407 to Hwang, entitled PREALARM SYSTEM FOR AN ANTITHEFT ALARM, issued Jun. 1, 1993. Hwang discloses a prealarm system utilizing a one shot timer circuit. These prior art devices are not particularly suited for utilization in small boats, which offer a unique set of requirements.

An anti-theft device for small boats first require small size, low weight, low cost and high reliability. Also, such a system must be able to operate in an environment with varying conditions such as a temperature operating range between −20° to 120° F. Such a device also must be able to be operated from a 12 volt boat battery and have low current drain in the quiescent "off" state, so that the battery is not run down. It would also be desirable to include a backup battery. A backup battery would prevent a burglar from circumventing the system by cutting the boat battery cable or otherwise disconnecting the battery.

An anti-theft device for boats also require small sensor devices that do not cause sparks. Such a device should also be capable of driving commercially available output warning devices including sirens and/or lights. Another requirement includes a timing control that automatically turns off the warning device after a fixed period of time. This would alert marina personnel to an attempted theft without causing an annoyance by staying on continually. The timing control should also include preventing the alarm from being activated due to a momentary transients such as the boat rocking, but latches up after a predetermined period of time, such as one to three seconds.

It is therefore, an object of the present invention to provide an alarm system that is low enough in cost and power drain to be utilized in a boat and, further having a timing control that prevents the system from being activated by momentary transients.

SUMMARY OF THE INVENTION

An intrusion detection system is disclosed including a sensor means for providing a first signal indicative of an intrusion and a second signal indicative of an absence of the intrusion. Alarm control means coupled to said sensor means including an oscillator coupled to a counter. The control means responsive to the first signal to activate the oscillator and counter in a first interval (T1) during which the first signal remains indicative of an intrusion and then to lock the sensing means to produce the first signal in a second interval (T2) indicative of a continuous alarm condition. The control means for further resetting the sensor means in the continuous alarm condition after the second interval.

BRIEF DESCRIPTION OF THE DRAWING

The above objects, further features and advantages of the present invention are described in detail below in conjunction with the drawings, of which.

DETAILED DESCRIPTION OF THE DRAWING

The present invention is directed to an intrusion detection system that generates timing signals T1 and T2 corresponding to the various modes of operation. A sensor means provides a first signal indicative of an intrusion followed by a second signal indicative of an absence of the intrusion prior to signal T1, which indicates a false alarm mode and the system is placed in the quiescent mode. The signal T1 is indicative of a true alarm mode where the system is activated for an extended period of time and provides an audible and/or visual alarm indicative of the intrusion. The signal T2 occurs after a suitable time interval after which the alarm is disabled to prevent undue disturbance. In the present invention, the signals T1 and T2 are generated by a control circuit including an oscillator which is normally in a "static" or unenergized state, thereby providing low power drain for the present invention.

Figure 1:
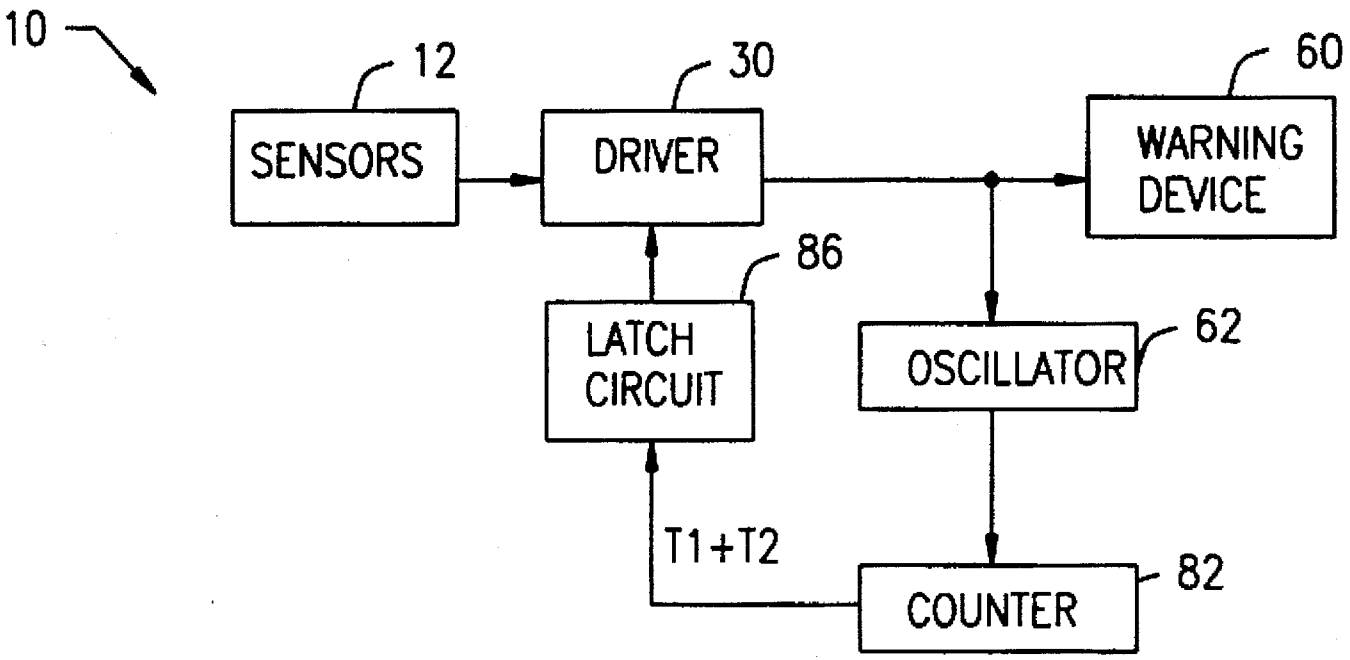
FIG. 1 is a block diagram of the intrusion detection system according to the present invention.

Referring to FIG. 1, there is shown a block diagram of the intrusion detection system according to the present invention. The system 10 includes sensors 12 which are located in the vulnerable areas of a boat such as doors and/or windows. The term "sensors" is being used to indicate that more than one sensor is provided. However, a single sensor being employed is contemplated as well. The sensors 12 are capable of providing signals indicating that the sensors have been set by someone attempting to wrongfully gain access to these vulnerable areas of the boat. Such sensors can include mechanical switches, magnetically activated switches, conductive tape, glass detectors, vibration detectors and a host of other on/off type devices that are well known.

Coupled to the sensors 12 is a driver 30, which is utilized to detect the signals generated by the sensors 12 and to provide the power to drive a warning device 60. The warning device 60 may be one of several types including various sirens, alarms or a flashing light device. As can be seen, the driver 30 is controlled by a feedback loop including an oscillator 62, a counter 82 and a latch circuit 86. The oscillator 62 which is kept in a "static" or unenergized state, until activated by the driver 30, provides an oscillating signal which is utilized to trigger the counter 82. The counter 82 is utilized to provide timing signals T1 and T2 which are sent to the latch circuit 86. The latch circuit 86 utilizes timing signal T1 to operate the driver 30 so that the warning device is turned on for an extended period of time only if the signal from the sensors 12 persists for an extended period of time. The latch circuit 86 utilizes timing signal T2 to operate the driver 30 so that the warning device 60 is turned off after the extended time period.

During operation, the system is normally in the quiescent "off" state, which means the driver 30 is turned off not providing any power to the warning device 60. The driver 30 in the "off" state also keeps the oscillator 62 in a "static" or unenergized state and thus does not provide the oscillating signal. In the present invention the oscillator 62 being held in the "static" state causes it to draw substantially less current or power, which contributes to the energy efficiency of this system 10. However, in this state the latch circuit 86 biases the driver 30 so that it is readily turned on when at least one of the sensors 12 is set or operated.

When one of the sensors 12 is set by an intrusion, a signal is produced which switches the driver 30 to an "on" state. The driver 30 in the "on state" provides power to operate the warning device or siren 60 and to activate the oscillator 62. The oscillator 62 being activated causes the counter 82 to begin to count.

After a predetermined period of time, the counter 82 reaches a count which is utilized to generate the T1 signal received by the latch circuit 86. This signal operates the latch circuit 86 so that it locks the driver 30 in the "on" state regardless of the signals received from the sensors 12. The T1 signal is only produced when the sensors 12 provide a continuous signal to the driver 30 for an extended period of time, which indicates that the sensors 12 were set by a real response. When the sensors 12 are disturbed by a momentary transient such as the boat rocking or banging against the slip, the signal duration is not suitable to enable the counter 82 to reach the count indicative of the T1 signal. In this situation, the signal provided by the sensors 12 terminates before the count T1 is reached. This causes the driver 30 and oscillator 62 to be turned off, and further resets the counter 82, which is the quiescent "off" state of the system 10.

The system 10 is locked in the "on state" by the generation of the T1 signal. The system 10 remains in this state until being automatically turned off by the T2 signal. The T2 signal is generated at a second predetermined period of time, which corresponds to another count of the counter 82. The T2 signal operates the latch circuit 86 so that driver 30 is turned off and returned to the quiescent "off" state thereafter. In this way, the alarm, after a T2 operating period (3–12 minutes), is turned OFF whether or not the sensors 12 is still set.

Figure 2A:
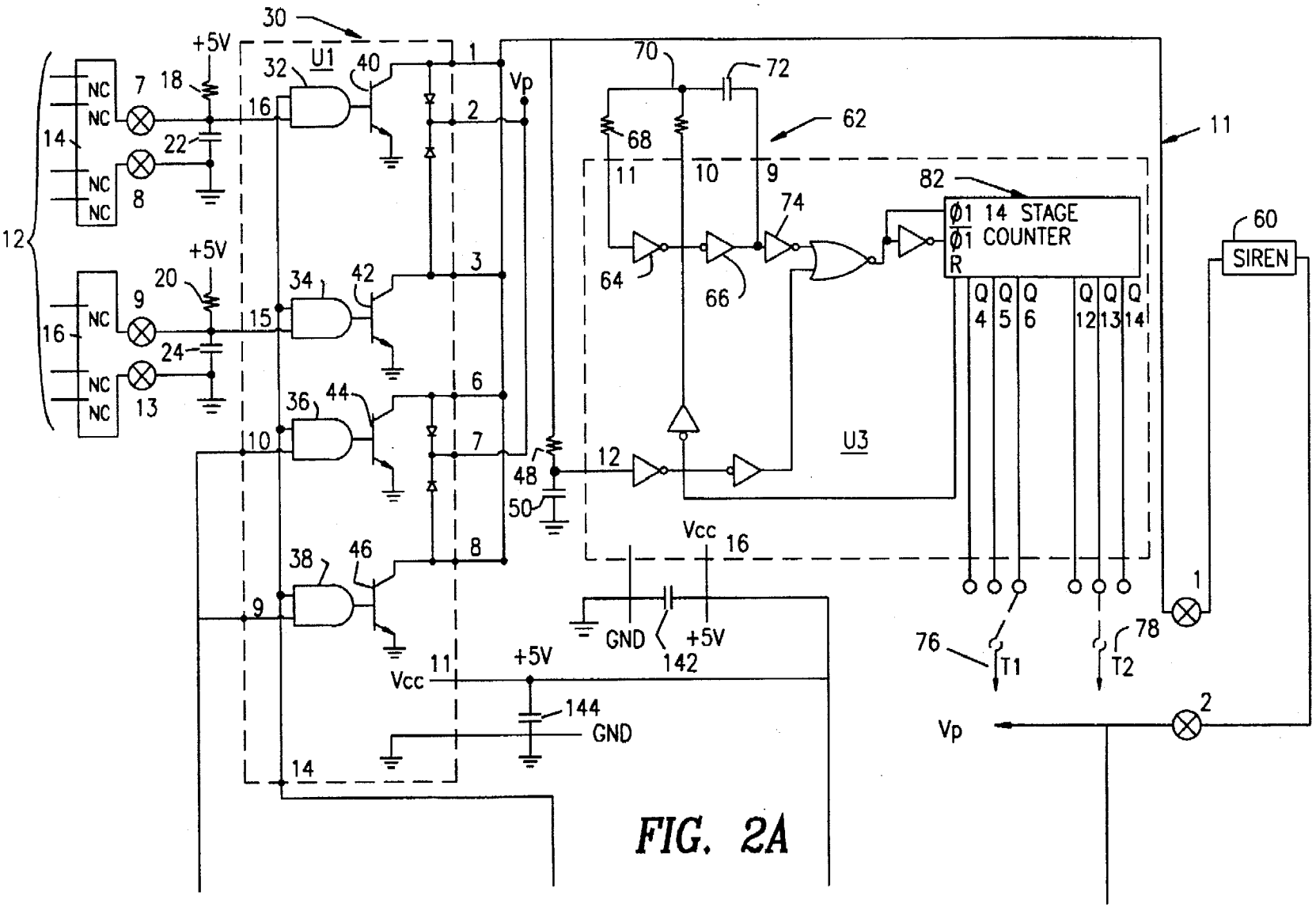
FIGS. 2A and 2B is a schematic diagram of one possible embodiment of the intrusion detection system according to the present invention.
Figure 2B:
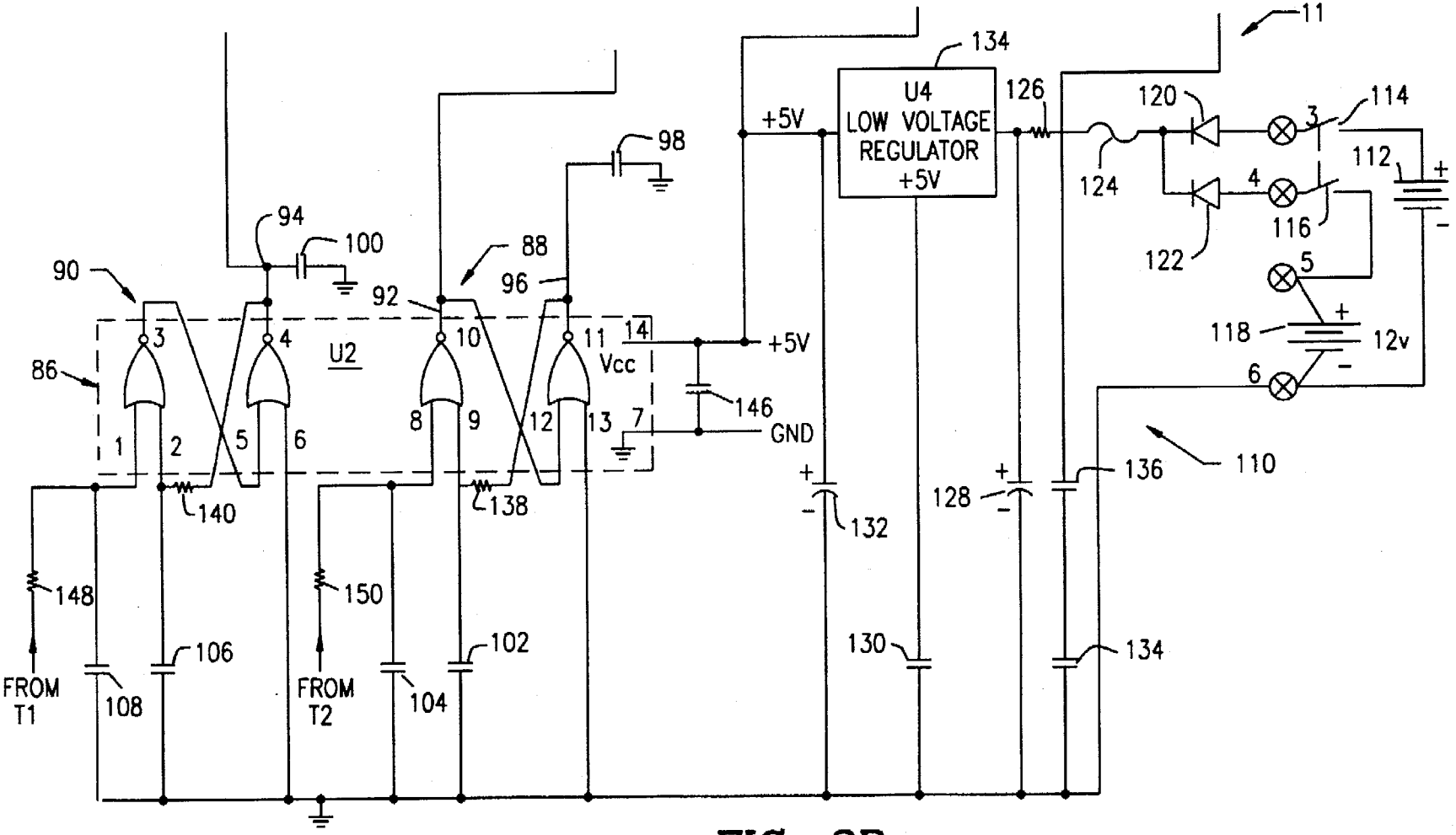

Referring to FIGS. 2A and 2B, a schematic diagram of one embodiment of the intrusion detection system according to the present invention is shown. This particular embodiment utilizes commercially available integrated circuits to achieve the desirable features of the present invention. These features include very low current drain, high reliability, small size and low cost. For example, the alarm circuit 11 nominally draws three milliamperes from a twelve volt battery and also is operable with a battery having a voltage as low as eight volts. This means that the drain on the boat battery is approximately one half ampere-hour per week, which is a relatively light load.

The use of integrated circuits instead of discrete components also reduces costs by reducing the number of parts to be purchased and assembled. Utilizing integrated circuits further reduces costs by limiting circuit board costs by decreasing the board area required. The integrated circuits utilized in this embodiment are inexpensive and available from multiple sources. Thus, the manufacturer or service person is not limited to one source. Therefore, this embodiment is efficient and low cost.

Still referring to FIGS. 2A and 2B, this particular circuit 11 represents one possible embodiment of the block diagram of FIG. 1. This embodiment 11 also includes a power section 110, which will be described first before discussing the rest of the circuit 11. The power section 110 includes terminals 3, 4, 5 and 6, which are utilized to couple the batteries 112,118 to the system 11. The boat battery 112 is coupled across terminal 3 and 6 through a switch 114, while the backup battery 118 is coupled across terminals 5 and 6. A switch 116 couples terminal 5 to terminal 4. The preferred configuration is for the switches 114,116 to be ganged together.

Both switches 114,116 are utilized to connect and disconnect the batteries 112,118 to the system 11. Terminals 3 and 4 are coupled to the rest of the power section 110 by two diodes 120,122. The cathodes of both diodes 120,122 are coupled to the input of a voltage regulator 134 through a fuse 124 and a current limiting resistor 126. The resistor 126 along with the fuse 124 provide circuit protection. The voltage regulator 134 is preferably a five volt integrated circuit regulator U4 with a small quiescent current. The output of the regulator 134 is coupled to the power pins of integrated circuits U1, U2 and U3 for providing power thereto, as well as to the resistors 18 and 20. Coupled between the power and ground pins of U1, U2 & U3 are capacitors 142,144,146 which are utilized to filter the voltage received from the regulator 134. Coupled between the regulator 134 and ground are three bypass capacitors 128, 130,132 which are utilized to eliminate any transients or noise signals. Coupled between node Vp and ground are two additional bypass capacitors 134,136.

The circuit 11 is activated when either of the switches 114,116 is closed. When the switch 114 is closed, current from the boat battery 112 flows through the switch 114, diode 120, fuse 124, resistor 126 and into the regulator 134. Assuming a nominal boat battery voltage of 12.6 volts, the voltage at node Vp is about 12 volts. The five volt output of the regulator 134 supplies approximately two milliamperes to U1, U2, U3 and resistors 18,20. The regulator 134 typically has a quiescent current of 0.4 milliamperes. Approximately 0.6 milliamperes flows from node Vp through the siren 60, while a very small amount of leakage current flows through the bypass capacitors 128,130,132. Summing these currents, the typical drain from the battery is nominally three milliamperes.

The backup battery 118 supplies power to the circuit 11 if the boat battery 112 is disconnected or if the boat battery voltage falls below that of the backup battery 118. Current from the backup battery 118 flows through switch 116, diode 122, fuse 124 and resistor 126 into the voltage regulator 134. Typically the backup battery 118 is a dry cell such as a lantern battery, which should be located in an alarmed area.

Still Referring to FIGS. 2A and 2B, the sensors 12 are coupled to input terminals 7,8 and terminals 9,13. The sensors 12 are preferably magnetically actuated reed switches. Each switch has a normally closed contact and are coupled to each other in a series configuration. FIGS. 2A and 2B shows a series configuration of four switches 14 coupled to terminals 7 and 8, while a series configuration of three switches 16 are coupled to terminals 9 and 13. The switches 14,16 operate to provide a ground potential when all of the contacts are in the closed position. The switches 14,16 further operate to provide a positive voltage level or a logic high when one of the contacts open.

The driver 30 is embodied by an integrated circuit U1, which includes four AND gates 32,34,36,38 coupled to associated transistors 40,42,44,46. The collectors of the transistors 40,42,44,46 are coupled together and, further coupled to both the siren 60 and oscillator 62. The siren 60 is a specific embodiment of the previously described warning device.

The oscillator 62 and counter 82 are embodied by the integrated circuit U3. The input of the oscillator 62 is pin 12 of U3, which is coupled to the driver transistors 40,42,44,46 through a charging resistor 48. A capacitor 50 is also coupled to pin 12 in order to store a reset level which keeps the oscillator 62 turned off or in the "static" state. The basic portion of the oscillator 62 includes two inverters 64,66 coupled in a series configuration. The oscillator 62 further includes two resistors 68,70 and a capacitor 72 coupled to the inverters. The counter 82, which is a fourteen stage counter, has two adjustable outputs 76,78 which can be tied to the different Q-outputs. This configuration enables the timing signals T1 and T2 to be selectively varied.

The latch circuit 86 is embodied by the integrated circuit U2, which includes a first flip-flop 88 and a second flip-flop 90. The signals T1 and T2 are coupled to the flip-flops 88,90 through a respective resistor 148,150. Coupled to each flip-flop 88,90 is an additional resistor 138,140. The flip-flops 88,90 are further coupled to ground through four capacitors 102,104,106,108. The reset output 92 of the first flip-flop 88 is coupled to one input of each of the AND gates 32,34,36,38, while the set output 94 of the second flip-flop 90 is coupled to one input of two of the AND gates 36,38. Coupled to the set outputs 94,96 of the flip-flops 88,90 are capacitors 98,100. These capacitors 98,100 ensure that the flip-flops 88,90 are placed in the reset state when the alarm circuit 11 is initially activated.

During operation, as previously described both flip-flops 88,90 are initially placed in the reset state. The reset output 92 of the first flip-flop 88 is utilized to prime the AND gates 32,34,36,38, while the set output 94 of the second flip-flop 90 is utilized to disable the two driver gates 36,38 ensuring the associated transistors 44,46 remain turned off. As long as all of the contacts in the switches 14,16 remain closed, the AND gates 32,34 are disabled ensuring the associated transistors 40,42 remain turned off. This ensures that the siren 60 is not activated.

If one of the switches 14,16 is disturbed, one of the normally closed contacts open. This causes a high logic condition to be placed on the other input of one of the AND gates 32,34, thus turning on one of the associated transistors 40,42. The collector voltage of one of the associated transistors 40,42 is then pulled to ground, which causes current to flow from node Vp through the siren 60 to ground. This results in the siren 60 being activated producing an audible output.

One of the associated transistors 40,42 being turned on also removes the reset level from pin 12 of U3 which turns on the oscillator 62. The oscillator 62 being turned on generates an oscillating signal which triggers the counter 82. The oscillator 62 is preferably configured to trigger the counter 82 every 0.05 seconds. Thus, the counter's Q4 output transitions positive after 0.8 seconds, Q5 transitions positive after 1.6 seconds, and Q6 transitions positive after 3.2 seconds.

Assuming the T1 output 76 is connected to Q6 of the counter 82 as shown. If the contact in one of the switches 14,16 closes again before 3.2 seconds, the reset level is returned to pin 12 of U3 which turns off the oscillator 62 and siren 60 returning the circuit 11 to its quiescent state. If the contact remains open for 3.2 seconds or longer, then the T1 signal produced by the counter 82 sets the second flip-flop 90. The AND gates 36,38 are enabled, which turns on the associated transistors 44,46. This locks the circuit 11 in the "on" state since the oscillator 62 and siren 60 remain activated regardless of the inputs from the switches 14,16. The circuit remains locked in the "on" state until signal T2 sets the first flip-flop 88.

Assuming that the T2 output 78 is connected to Q13 of the counter 82 as shown. After 6.8 minutes, the T2 signal is produced which sets the first flip-flop 88. This causes the reset output 92 to transition to ground, which disables all of the AND gates 32,34,36,38 turning off the associated transistors 40,42,44,46. Then the oscillator 62, counter 82 and siren 60 are turned off. The alarm circuit 11 is left in this "off" state for as long as power is applied. When the power switches 114,116 are opened and then closed again, the circuit 11 is returned to its quiescent state as described above.

The duration of the audible output from the siren 60 is adjustable by connecting the T2 output 78 to either Q12, Q13 or Q14 of the counter 82 in order to provide siren durations of 3.4, 6.8 or 13.6 minutes respectively. The length of T1 is also adjustable by connecting the T1 output 76 to either Q4, Q5 or Q6 of the counter 82 in order to provide a period of 0.8, 1.6 or 3.2 seconds before the siren is locked in the "on" state. The duration of the T1 and T2 is also adjustable by changing the values of the oscillator resistor 70 and capacitor 72.

For some applications, it may be desirable not to utilize the T1 or T2 signal. If the T1 signal is not utilized, the second flip-flop 90 is not set and the siren 60 is activated until the T2 signal is produced. However, if the contact in the switches 14,16 closes again before the T2 signal is produced, the siren 60 is turned off and the circuit 11 is then placed in the quiescent state. If the T2 signal is not utilized, the alarm circuit 11 is not automatically shut off. If the T1 signal is utilized and the T2 signal is not, the siren 60 will continue to sound until power is removed from the circuit 11. If both the T1 and T2 signals are not utilized, the siren 60 is activated any time a contact opens and turns off when all of the contacts close.

As previously described, both switches 14,16 include contacts which are separately wired in series, which enables the two AND gates 32,34 to be separately controlled. Such a configuration is desirable because it provides flexibility. However, if all of the contacts of both switches 14,16 are wired in one serial string, then pin 16 and 15 of U1 are tied together. This is the preferred configuration since it provides greater siren drive capability and reduces power dissipation in U1 when the siren 60 is turned on.

The intrusion system according to the present invention is specifically designed to be compact, low cost and energy efficient enough to be utilized in small boats. Although, the preferred environment is a boat, it is understood that this system can be employed in other environments as well. The present invention accomplishes this by utilizing inexpensive commercially available components and providing a timing circuit that prevents the system from being activated by momentary transients and also automatically shuts it off after a predetermined period of time.

While the invention has been particularly shown and described with reference to preferred embodiments thereof, it will be understood by those skilled in the art that changes in form and details may be made therein without departing from the spirit and scope of the present invention.

In a system of practical construction in accordance with the principles described, the components were as follows:

| | |
|---|---|
| U1 | T.I. SN75437ANE |
| U2 | Harris CD4001BE |
| U3 | Harris CD4060BE |
| U4 | Motorola LM2931Z-5.0 |
| Capacitor 22 | 0.1 microfarads |
| Capacitor 24 | 0.1 microfarads |
| Capacitor 50 | 1000 picofarads |
| Capacitor 72 | 0.47 microfarads |
| Capacitor 98 | 150 picofarads |
| Capacitor 100 | 150 picbfarads |
| Capacitor 102 | 1000 picofarads |
| Capacitor 104 | 1000 picofarads |
| Capacitor 106 | 1000 picofarads |
| Capacitor 108 | 1000 picofarads |
| Capacitor 128 | 100 microfarads |
| Capacitor 130 | 0.47 microfarads |
| Capacitor 132 | 100 microfarads |
| Capacitor 134 | 0.47 microfarads |
| Capacitor 136 | 0.47 microfarads |
| Capacitor 142 | 0.1 microfarads |
| Capacitor 144 | 0.1 microfarads |
| Capacitor 146 | 0.1 microfarads |
| Fuse 124 | 1.5 Amps |
| Resistor 18 | 10 Kohms |
| Resistor 20 | 10 Kohms |
| Resistor 48 | 10 Kohms |
| Resistor 68 | 620 Kohms |
| Resistor 70 | 82 Kohms |
| Resistor 126 | 27 ohms |
| Resistor 138 | 10 Kohms |
| Resistor 140 | 10 Kohms |
| Resistor 148 | 10 Kohms |
| Resistor 150 | 10 Kohms |
| Siren | 12 Volt |
| Switches 14, 16 | 507-AMS-39G or 507-AMS-9G |
| Diodes 120, 122 are practically any commercially available diode with a forward current rating of 2 Amperes. | |

What is claimed is:

1. An intrusion detection system, comprising:

sensor means for providing a first signal indicative of an intrusion and a second signal indicative of an absence of the intrusion; and alarm control means coupled to said sensor means including an oscillator coupled to a counter, wherein said oscillator is normally in a "static" state where said oscillator is turned off and does not provide an oscillation signal, said control means responsive to said first signal to activate said oscillator and counter in a first interval (T1) during which said first signal remains indicative of an intrusion and to lock said sensing means in a second interval (T2) indicative of a continuous alarm condition, said control means for further resetting said sensor means in said continuous alarm condition after said second interval.

2. The system of claim 1, wherein said sensor means includes at least one switch containing a normally closed contact which produces a predetermined voltage when said normally closed contact opens.

3. The system of claim 2, wherein said switch is a magnetically actuated reed switch.

4. The system of claim 1, which further includes a warning device coupled to said sensing means which is selected from a group consisting of an alarm, a siren and a flashing light device.

5. The system of claim 1, wherein said sensor means includes a driver.

6. The system of claim 5, wherein said driver includes a plurality of logic gates, wherein each said logic gate has an output coupled to an associated transistor.

7. The system of claim 6, wherein said plurality of logic gates are AND gates.

8. The system of claim 7, wherein said alarm control means further includes a latch circuit coupled between said counter and said driver, said latch circuit for biasing said driver to be switched between an "off" state and an "on" state independent of said first and second sensor signals after said first time interval has been reached.

9. The system of claim 8, wherein said latch circuit locks said driver in said "on" state in response to a first timing signal produced by said counter after said first interval.

10. The system of claim 9, wherein said latch circuit switches said driver to said "off" state in response to a second timing signal produced by said counter after said driver is locked into said "on" state for said second interval.

11. The system of claim 10, wherein said first and second intervals are variable.

12. The system of claim 11, wherein said latch circuit includes two flip-flops.

13. An intrusion detection system including a sensor to detect an intrusion and a siren for alerting a user of the intrusion, comprising:

a driver for activating a warning device when said driver is switched to an "on" state in response to a sensor being activated by the intrusion;

an oscillator normally in a "static" state where said oscillator is turned off and does not provide an oscillation signal, wherein said oscillator is activated by said driver being switched to said "on" state to provide said oscillation signal;

a counter responsive to said oscillation signal for producing a first timing signal and a second timing signal if the sensor is operated in an intrusion detection mode for a first predetermined period of time, said second timing signal is produced after a second predetermined period of time from when said first timing signal is produced indicative of an intrusion detection alarm period; and a latch circuit coupled between said counter and said driver, said latch circuit locks said driver in said "on" state in response to an intrusion and operative to switch said driver off in response to said second timing signal indicative of the end of said alarm period.

14. The system of claim 13, wherein said driver includes a plurality of logic gates, wherein each said logic gate has an output coupled to an associated transistor.

15. The system of claim 14, wherein said logic gates are AND gates.

16. The system of claim 13, wherein said latch circuit includes two flip-flops.

17. The system of claim 13, wherein said counter is a fourteen stage counter.

18. The system of claim 13, wherein said oscillator includes two inverter devices.

19. The system of claim 18, wherein said oscillator further includes two resistors and a capacitor.

20. The system of claim 13, wherein said first and second predetermined period of time are variable.

* * * * *